US006053800A

United States Patent [19]

Lattanzi

[11] Patent Number: 6,053,800

[45] Date of Patent: Apr. 25, 2000

[54] FRAMEWORK FOR THE RIGIDIFICATION OF A PART OF GARMENT, MADE OF A THERMOPLASTIC OR THERMOSETTING MATERIAL WITH RIGIDIFICATION LONGITUDINAL FIBRES

[75] Inventor: Nicolas Lattanzi, Saint Clair de la Tour, France

[73] Assignee: Playtex Apparel, Inc., Stamford, Conn.

[21] Appl. No.: 09/111,119

[22] Filed: Jul. 6, 1998

[30] Foreign Application Priority Data

Jul. 9, 1997 [FR] France ..... 97 08979
Oct. 27, 1997 [FR] France ..... 97 13607

[51] Int. Cl.[7] ..... A41C 1/12

[52] U.S. Cl. ..... 450/41; 450/47; 450/52

[58] Field of Search ..... 450/40–48, 50–54; 2/255–258, 261

[56] References Cited

U.S. PATENT DOCUMENTS

| | | | |
|---|---|---|---|
| Re. 22,771 | 7/1946 | Licht . | |
| 351,344 | 10/1886 | Stone et al. | 2/255 |
| 724,011 | 3/1903 | Hudson | 2/255 |
| 1,798,274 | 3/1931 | Pons . | |
| 2,454,152 | 11/1948 | Glick . | |
| 2,530,829 | 11/1950 | Licht . | |
| 2,649,586 | 8/1953 | Josephson | 2/255 |
| 2,773,265 | 12/1956 | Dick . | |
| 2,824,563 | 2/1958 | Hill . | |
| 2,883,988 | 4/1959 | Lee . | |
| 3,037,211 | 6/1962 | Bohm | 2/255 |
| 3,067,750 | 12/1962 | Schwartz . | |
| 3,195,541 | 7/1965 | Zurkowski . | |
| 3,528,430 | 9/1970 | Child . | |
| 3,531,807 | 10/1970 | Devito et al. . | |
| 3,747,606 | 7/1973 | Tareau . | |
| 3,750,673 | 8/1973 | Penrock . | |
| 3,799,175 | 3/1974 | Rowell . | |
| 3,884,244 | 5/1975 | Rowell . | |
| 4,275,740 | 6/1981 | Weston . | |
| 4,558,705 | 12/1985 | O'Boyle et al. . | |
| 4,646,746 | 3/1987 | O'Boyle et al. . | |
| 4,770,650 | 9/1988 | Rowell . | |
| 4,798,557 | 1/1989 | Scott . | |
| 5,084,222 | 1/1992 | Glemet et al. . | |
| 5,141,470 | 8/1992 | Morgan et al. . | |
| 5,167,891 | 12/1992 | Dijkman, Sr. et al. . | |
| 5,219,311 | 6/1993 | Fildan . | |
| 5,401,203 | 3/1995 | Fildan . | |
| 5,472,366 | 12/1995 | Moore . | |
| 5,527,202 | 6/1996 | Morgan et al. . | |
| 5,624,386 | 4/1997 | Tailor et al. . | |

*Primary Examiner*—Gloria M. Hale
*Attorney, Agent, or Firm*—Abelman, Frayne & Schwab

[57] ABSTRACT

A framework is disclosed for the rigidification of a part of a garment, which may typically be the curved underwire support of a brassiere. The framework is formed of a molded plastic, which may be thermoplastic or thermosetting and includes short rigidified fibers embedded therein. The fibers are oriented along curvatures which are parallel to the curvature of the framework. The fibers which can be glass, carbon or aromatic polyamides, are preferably a polyamide in which one aromatic group is substituted for an aliphatic group in an aliphatic chain, or a combination of these materials.

20 Claims, 3 Drawing Sheets

FRAMEWORK FOR THE RIGIDIFICATION OF A PART OF GARMENT, MADE OF A THERMOPLASTIC OR THERMOSETTING MATERIAL WITH RIGIDIFICATION LONGITUDINAL FIBRES

This invention relates to a framework for the rigidification of a part of garment, made of thermoplastic or thermosetting material, and more specifically to an underwear a part of which requires a rigidification means.

Until now, the prior art rigidifying frameworks for a part of garment were generally made of metal, although there are some attempts to make them of a thermoplastic material.

The framework made of metal wire have indeed an interesting rigidity due to the high elastic modulus of metal, and especially of steel. They suffer however of some drawbacks such as lack of elastic memory, resulting in permanent distortions under some stress or washing operations, as well as a poor protection against corrosion and/or oxidation.

The prior art thermoplastic frameworks have obviated such corrosion and oxidation problems, but require cross sections with a high superficial inertia and possibly also a reinforcement comprising short glass fibres, which results in a satisfying rigidity, although lower than the rigidity provided by steel. The short fibres used up to now have a length generally comprised between about 0,2 mm and 1 mm, such range of length being unsuitable for an optimal result regarding the rigidification, as explained more in detail hereunder.

The rigidifying framework according to the present invention overcomes the problems raised by the framework made of metal or of thermoplastics with short fibres as described above.

As already mentioned, the framework according to the present invention comprises a matrix of a thermoplastic or thermosetting material.

A wide range of thermoplastic materials can be used. Some examples are:

- the aliphatic polyamides such as the polyamides designated by PA 6—6, PA 6, PA 11 and preferably PA 12, the latter having the basic structure: $+(—NH—(CH_2)_{11}—CO—)_n$;
- the aromatic polyamides such as the polyamide designated by PA 46, which is also preferred;
- the polymers and copolymers of styrene, such as the acrylonitrile—butadiene—styrene polymers (ABS), the acrylonitrile—styrene—acrylate polymers (ASA), the styrene—acrylanitrile polymers (SAN), the styrene—butadiene polymers (S/B), the styrene—maleic anhydride polymers (SMA), the styrene—αmethylstyrene polymers (S/MS);
- the polyolefinic materials, such as the polyethylene (PE) and preferably the polypropylene (PP);
- the polyacetals such as preferably the polyoxymethylenes (POM);
- the polycarbonates (PC); and
- the saturated polyesters such as, preferably, the polyethylene—terephtalate (PET) and the polybutyrene—terephtalate (PBT). Similarly, a wide range of thermosetting materials can be used. Some examples are:
- the unsaturated polymers (UP);
- the polyepoxides (EP), which are among the preferred materials;
- the polyurethanes (PUR);
- the polyacrylic polymers (PMMA) and copolymers; and
- the polyimides (PI).

According to a major feature of the invention, the said matrix is rigidified by fibres which are oriented along curvatures which are parallel to the framework generating lines. This means that said fibres are constantly parallel to the average arc which forms the theoretical axis of the framework.

This can be made following several ways:

According to a first possible embodiment, the framework can comprise at least one rigidifying fibre of a length which is equivalent to the total spread length of the framework, i.e. to the addition of the lengths of the elementary curves of various curvatures taken from one end of the framework until the other end thereof. Such fibres are therefore connecting both ends of the framework.

According to a second possible embodiment, the framework can comprise, firstly, at least one rigidifying fibre connecting its both ends, together with, secondly, in addition, a given percentage of fibres meeting the above major feature, the length of which is more than 5 mm. Said fibre percentage is given by the ratio of the total volume of said fibres longer than 5 mm to the total volume of the framework. According to the invention, said ratio, i.e. said percentage, is comprised between 0% and 90%.

According to a third possible embodiment, the framework can comprise only a given percentage of fibres longer than 5 mm.

According to the invention, said percentage is also comprised between 0% and 90%. In the two latter embodiments it should be understood that the length of the fibres longer that 5 mm is strictly smaller than the length of the spread framework and therefore said fibres are clearly distinguished from the fibre(s) connecting the both ends of the framework.

Inasmuch the framework size can vary with the size of the garment which is to be rigidified, the fibre length can also vary according to the size of the framework, especially in the case of the two first embodiments, although this is not strictly required, especially in the case of the third embodiment. In all cases, the volume assigned to the matrix cannot be less than 10% of the framework total volume. To fulfil their function, the rigidifying fibres must have a diameter comprised between 0,05 mm and 3 mm, and preferably 0,1 mm and 3 mm, depending upon the material of which said fibres are made.

According to the present invention, the material of which said fibres are made can be glass, carbon or aromatic polyamides, preferably a polyamide in which one aromatic group is substituted to an aliphatic group in an aliphatic chain, or a combination of these materials.

For structural reasons, the diameter of the fibreglass is comprised between 0,2 mm and 2,5 mm, whereas the diameter of the carbon fibres is about 0,1 mm. The aromatic polyamides are employed with diameters comprised between 2 mm and 3 mm.

The diameter, and the selected material, can also be varied according to the process used to build the framework according to the invention. Said process can be thermoforming, injection, compression molding and pultrusion. In this case, the fibre diameter can be comprised between 0,05 mm and 0,8 mm. For insert molding and coextrusion processes, the fibre diameter should be higher, comprised between 0,8 mm and 3 mm.

According to a posible example, an aromatic polyamide which can be employed can be an isophtalic polyamide having the basic structure formula:

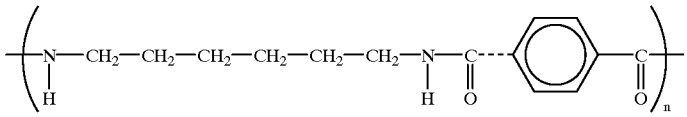

From a general point of view, it is also possible to use other aromatic polyamides available on the market, such as the following, known under the trade marks: Kevlar, Grivory, Arlen, Twaron, Ixef, . . .

The invention is preferably applied to brassieres, but can obviously also be applied to other garments, as for instance collars or shirts in some parts which have to be reinforced of working clothes.

The bras of swimming costumes or wasp waisters are also included in the invention.

The invention will now be described more in detail with reference to the attached drawing, on which:

The wire framework (1) according to the present invention comprises rigidifying fibres (Fn) oriented along curvatures (C) which are parallel to the outer curvatures of said framework (1). In other words, the curves (C) of the rigidifying fibres (Fn) have axis which are parallel to the generating lines (G) of the volume defined by the framework (1).

Said fibres (Fn) having a high elasticity module, they are used in an optimal way into the matrix when the framework is submitted to a deflection resulting from pulling and/or compressive efforts, exerted for example at the framework ends.

Such a geometrical arrangement has indeed for effect to get much benefit from the rigidifying fibres (Fn) in the bending conditions of the framework, since they are all employed, which is not possible with the prior art structures.

In fact, by using non oriented short fibres as in the prior art, the bending strength of the framework depends essentially on the mechanical properties of the matrix in which the fibres are embedded. The reason is that the prior art frameworks are generally obtained by an injection process making use of short fibres of a length comprised between 0,2 mm and 2 mm.

Such fibres having a length being shorter to the length and even to the overall size of the section of the framework, they can potentially take any orientation in a random manner. However, the mould temperature being less than the temperature of the injected plastic material, the fibres tend to flatten up along the surface of the mould and to align parallel to the injection flux, and therefore parallel to the mould walls.

Thus, the rigidily of the framework depends also at least on the ratio of said superficial parallel fibres, said ratio being itself governed by the selection of the matrix material, which can be crystalline, semi-crystalline or amorphous.

Inside the framework, since the fibres are randomly oriented, the rigidily is only depending on the selected matrix material. This is clearly not the case in the present invention.

Figure 1:
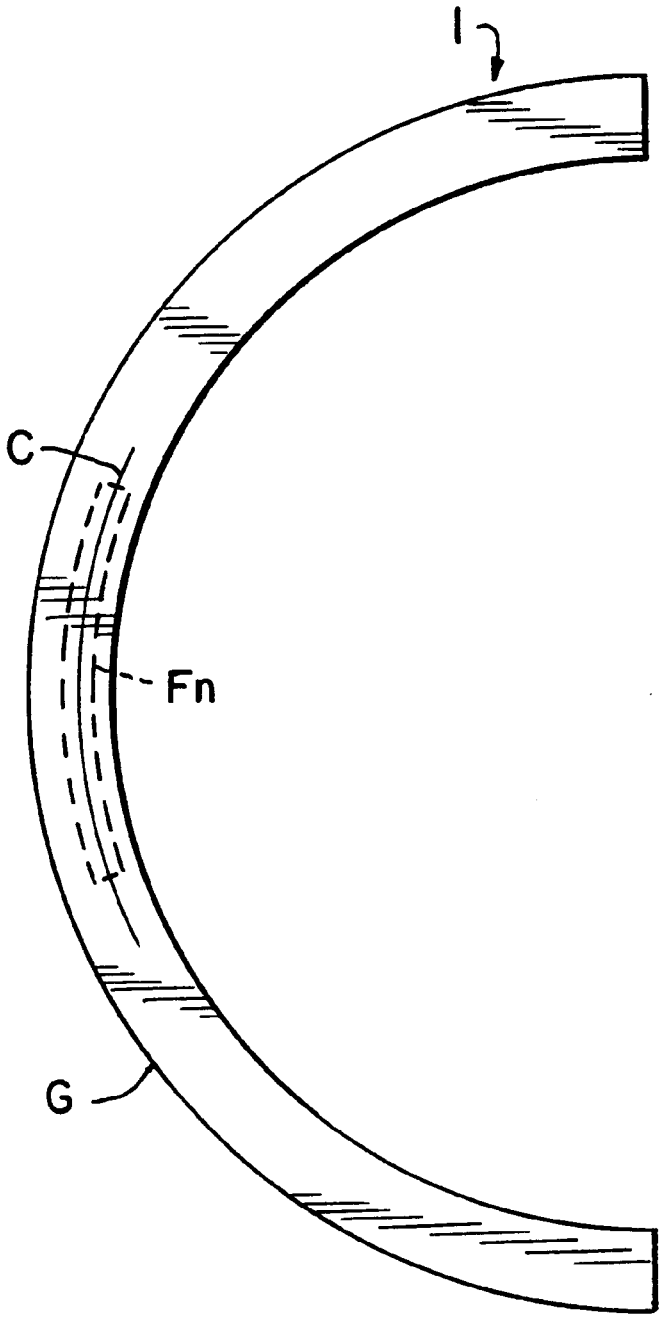
FIG. 1 shows a top view of a framework according to the invention, given as an example of the orientation of the rigidifying fibres.

Referring to FIG. 1, only one fibre (Fn) is shown. However, n is any integer symbolising the total number of fibres contained in the framework, whatever their length. The representation of one fibre in FIG. 1 has been therefore only chosen for clarity.

Figure 2:
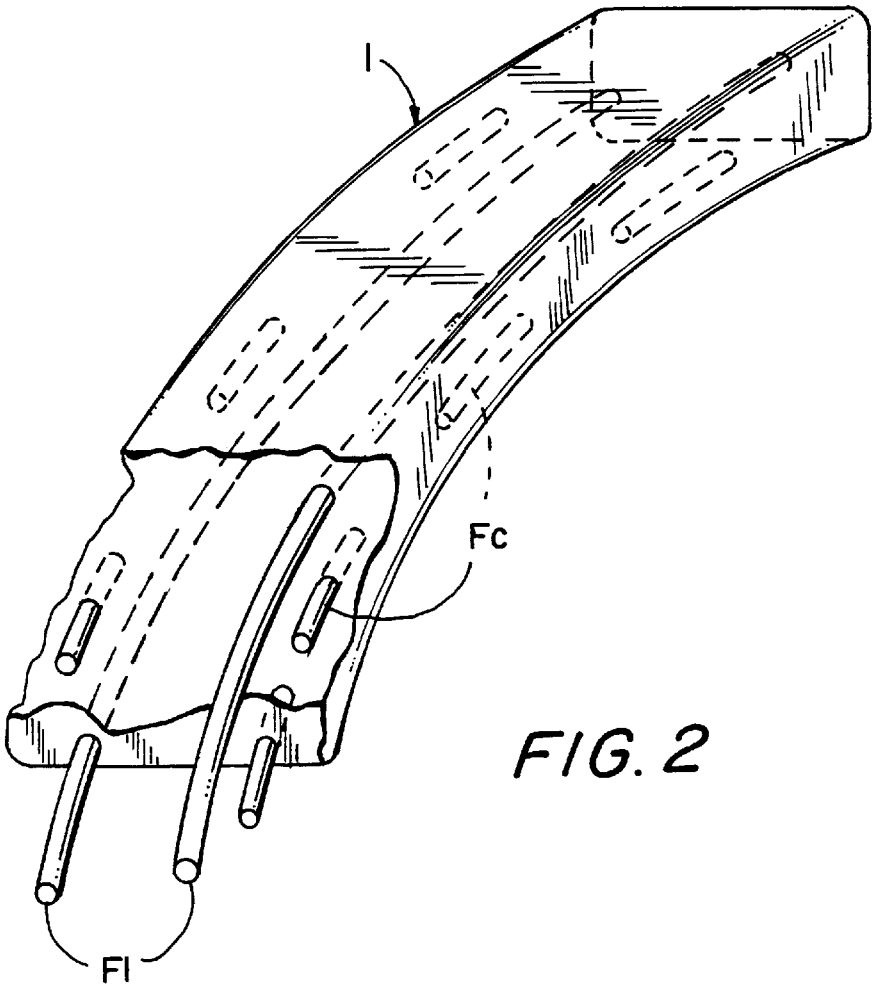
FIG. 2 is a perspective view showing a combination of various rigidifying fibres embedded in the matrix.

According to a first possibility, the rigidifying framework (1) is obtained by injection insert molding, and comprises at least one rigidifying fibre (Fl), as shown on FIG. 2, having a length equivalent to the total spread length of the framework (1), and also a percentage of further fibres having a length higher than 5 mm, as already mentioned.

Insert molding of at least one continuous fibre in a thermoplastic or thermosettable matrix in a mould, said matrix including a given percentage of fibres longer than 5 mm, results in a mixture of continuous fibres, of semi-long fibres and of the matrix. Since the mould cross section higher size is smaller than 5 mm, the orientation of the fibres along the curvatures of the framework is then automatic.

The reason is that the ratio of the highest cross section width of the framework (1) to the length of the rigidifying fibres (Fn) is less than 1, which implies that said fibres cannot take an orientation generally transverse but only an orientation generally longitudinal. The orientation of the fibres (Fn) along the framework curvature results therefore from the compared sizes of the mould and of the fibres, and from the injection process itself, generating a material flux.

The framework of the invention can also be obtained by different process such as thermoforming compression molding, pultrusion, coextrusion and the same.

In the case of use of the thermoforming process, the starting material for the matrix is in sheet or plate form, from which is obtained the 3D structure of the framework (1).

The compression molding ("Bulck molding compound") process uses preferably a starting material either in powder form or in a preform, to obtain the matrix, said starting material being placed into a mould cavity to be compressed, so that the material is softened to take the shape of said mould cavity.

In both cases, it can be obtained a quasi-isotropic structure which allows an improved behaviour of the framework (1) when twisted. Obviously, the framework can also comprise short fibres (Fc) of a length greater than 5 mm, in a given percentage depending on the framework volume.

The pultrusion process comprises a continuous impregnation of the fibres (Fn) by a resin or more generally by a plastic material forming the matrix, then the impregnated fibres pass through a guiding apparatus to a heating mould giving its final shape to the framework.

This process can be applied to thermoplastic and thermosetting materials, although it is more commonly used with the first designated. It results then in structures which are more rigid than the structures one could get with thermoplastic material, but less elastic, i.e. unable to take back their initial shape after mechanical stresses like torsion have been applied to them.

However, even if the response to mechanical stresses can be considered as less good, the real behaviour, for example as framework in a bra, is much better since it is more comfortable for the woman wearing said bra.

The fibres, impregnated with for instance epoxy resin coming out from a nozzle, are then wound round a shaping mandrel giving, on both sides of a longitudinal axis of this mandrel, two frameworks having an identical shape. The impregnated fibres have at this stage temperatures lower than the glasseous transition temperature, and they are consequently soft enough to be shaped on the mandrel.

Pultrusion can also be associated with a filament winding, i.e. when filaments impregnated with the same resin, in fleece, surround the aforementioned fibres. The impregnated pultruded fibres, as well as the filament winding, are wound around the same mandrel and polymerize together. The advantage of this particular process can be seen in the fact that the external surface of the framework is improved, due to the fleece, since the fibres are more uniforms and parallels in the framework, thus also improving the response to mechanical stresses, especially to torsion.

The coextrusion process is also a continuous process by which a bundle formed by fibres (Fn) is embedded by a extruded synthetic matrix, to obtain a coextruded framework. Said fibre bundle only includes in this case reinforcing fibres, with the exclusion of any additional material binding the fibres of the bundle.

In the two latter processes, it is necessary to cut the framework into pieces of the desired size.

The rigidifying fibres (Fn), (Fc), (F1) have a diameter which depends on the used process.

The smaller diameters, comprised between 0,05 mm and 0,8 mm, are used for the pultrusion, injection, thermoforming or compression molding. The three last processes require small diameter fibres, since the compression step they comprise would lead to a breakage of the fibres of higher diameters.

Also, during the shaping of the framework obtained by pultrusion, the fibres are broken when their diameter is too high.

Higher diameters, comprised between 0,8 mm and 3 mm can be used in the other processes such as insert molding or coextrusion. Insert molding causes a pressure exerted by the material of the matrix upon the fibres (Fn). If said fibres are too weak, they break.

Similarly, in the coextrusion process, the external or outer plastic material compresses the rigidifying fibres (5), which should therefore be strong enough.

In manufacturing the frameworks (1) of the invention, it is also possible to carry out a coextrusion process which is applied not directly on fibres but on a composite product comprising from the beginning fibres. In this case, however, the diameter of the fibres can be reduced to the values of the preceding range.

This particular coextrusion process is actually applied to a central pultruded material, a composite plastic for instance based on polyethylene terephtalate. This thermoplastic material improves the rigidity of the whole product, but suffers from a lack of elasticity.

This elastic composite core is then sheathed by an elastic material preventing moreover the internal filaments or fibres from getting out of the framework volume, which could be damageable for the material of the garment surrounding the framework, as well as for the skin of the person wearing said garment.

The sheathing, which is made by coextrusion applied to the central core obtained by pultrusion, can be made of a polyacetal, for instance a polyoxymethylene.

When using this making process, it is necessary to apply to the continuously coextruded product a post forming under heat.

Among the materials used for the rigidifying fibres (Fn, Fc, F1), and depending upon the used process, it can be used, as already mentioned, glass, carbon, aromatic polyamides or any combination of the same.

In fact, the elasticity and bending moduli of such materials allow a selection of fibres having Young moduli comprised between 10 000 Mpa and 280 000 Mpa, so that the rigidity of the framework can be adapted to any use and/or requirement.

As an example, the Young modulus of the carbon fibres is at the upper limit of the range, i.e. E=280 000 Mpa.

As an other example, the framework of the invention can be obtained by pultrusion or coextrusion of one of the previously mentioned materials.

All of the mentioned processes are used in the same way for short and long fibres.

Figure 3:
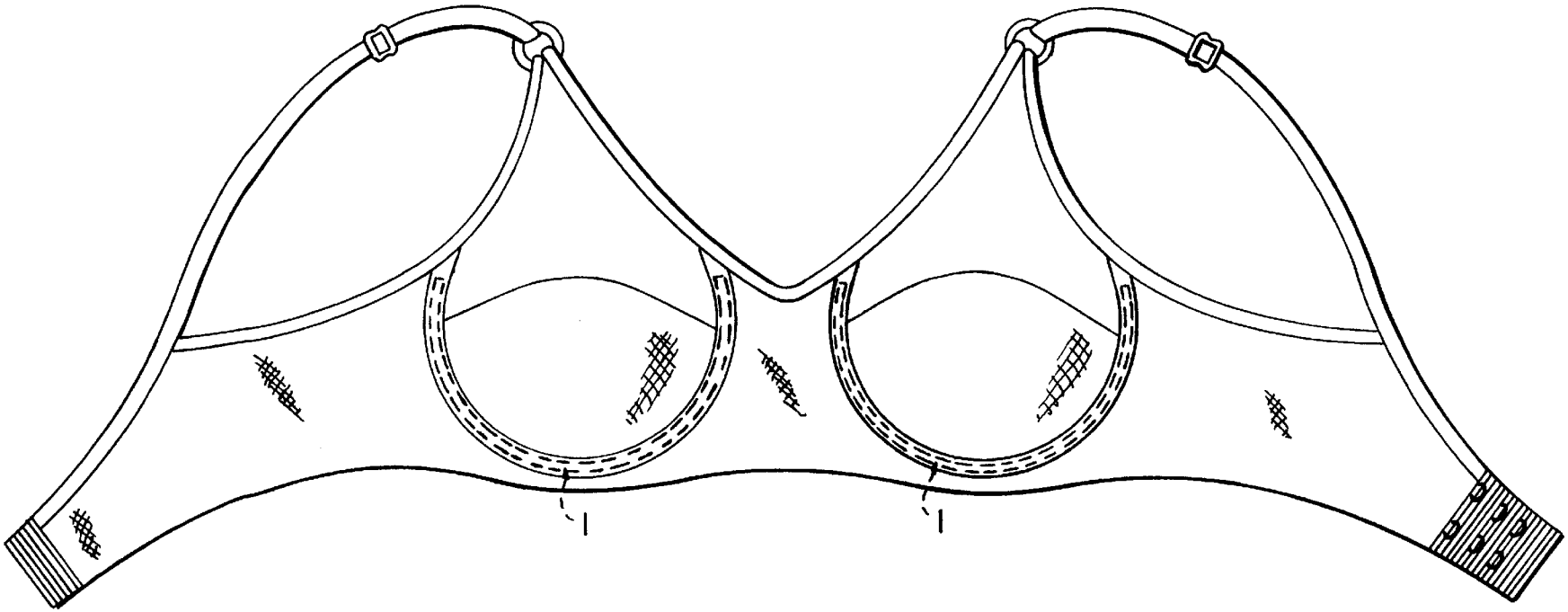
FIG. 3 shows a bra equipped with frameworks of the invention.

The wire framework (1) of the invention is advantageously used to rigidify a part of a underwear such as a bra, as illustrated by FIG. 3. It is then placed at the cup base, which is therefore rigidified.

I claim:

1. A rigidifying wire framework (1) for a part of a garment, comprising a matrix made of a thermoplastic or thermosetting material, characterised in that said framework (1) is of a generally arcuately shaped volume bounded by arcuate generating lines having a total spread length between its opposed ends, and includes arcuately extending rigidifying fibres (Fn) embedded within said volume which are oriented along curvatures (C) parallel to the arcuate generating lines of the volume defined by said framework (1).

2. A rigidifying wire framework (1) for a part of a garment according to claim 1, characterised in that it includes at least one rigidifying fibre (F1) having a length equivalent to the total spread length between the opposed ends of the framework.

3. A rigidifying wire framework (1) for a part of a garment according to claim 1, characterised in that it includes at least one rigidifying fibre (Fl) having a length equivalent to said total spread length of the framework, and a given percentage of the volume of said framework (1) of fibres (Fc) having a length longer than 5 mm and shorter than said total spread length.

4. A rigidifying wire framework (1) for a part of a garment according to claim 1, characterised in that a given percentage of the volume of said framework (1) includes fibres (Fc) having a length longer than 5 mm and shorter than said total spread length of said framework (1).

5. A rigidifying wire framework (1) for a part of a garment according to claim 3, characterised in that said percentage of the volume of the framework of fibres (Fc) is comprised between 0% and 90%.

6. A rigidifying wire framework (1) for a part of a garment according to claim 1, characterised in that the material the rigidifying fibres (Fn, Fc, F1) are made is selected from the group including glass, carbon, aromatic polyamides partially substituted by an aromatic group in the main aliphatic chain, and any combination of the same.

7. A rigidifying wire framework (1) for a part of a garment according to claim 1, characterised in that it is produced by a process selected among thermoforming, compression molding, injection, pultrusion and pultrusion associated with a filament winding.

8. A rigidifying wire framework (1) for a part of a garment according to claim 7, characterised in that the rigidifying fibres (Fn, Fl, Fc) are of a diameter between 0,05 mm and 0,8 mm.

9. A rigidifying wire framework (1) for a part of a garment according to claim 1, characterised in that it is produced by insert molding.

10. A rigidifying wire framework (1) for a part of a garment according to claim 9, characterised in that the rigidifying fibres (Fn, Fl, Fc) are of a diameter between 0,8 mm and 3 mm.

11. A rigidifying wire framework (1) for a part of a garment according to claim 1, characterised in that it is used to rigidify a lower part of the cups of a bra of underwear, swimming costumes or wasp waisters.

12. A rigidifying wire framework (1) for a part of a garment according to claim 1, characterized in that it is used to rigidify a collar of a shirt.

13. A rigidifying wire framework (1) for a part of a garment according to claim 1, characterized in that it is used to reinforce parts of working clothes.

14. An underwire support for a brassiere formed of a framework comprising a matrix made of a thermoplastic or thermosetting material, the framework being of a generally arcuate volume bounded by arcuate generating lines having a total spread length between its opposed ends, and including arcuately extending rigidifying fibres (Fn) which are oriented along curvatures (C) parallel to the arcuate generating lines of the volume defined by said framework.

15. An underwire support for a brassiere according to claim 14, characterised in that it includes at least one rigidifying fibre (Fl) having a length equivalent to said total spread length between the opposed ends of the framework.

16. An underwire support or a brassiere according to claim 14, characterised in that it includes at least one rigidifying fibre (Fl) having a length equivalent to said total spread length of the framework, and a given percentage of the volume of said framework (1) of fibres (Fc) having a length longer than 5 mm and shorter than said total spread length.

17. An underwire support for a brassiere according to claim 14, characterised in that the material of the rigidifying fibres (Fn, Fc, F1) is selected from the group including glass, carbon, aromatic polyamides partially substituted by an aromatic group in the main aliphatic chain, and combinations thereof.

18. An underwire support for a brassiere according to claim 14, characterised in that the said rigidifying fibres (Fn, Fl, Fc) are of a diameter between 0.05 mm and 0.8 mm.

19. An underwire support for a brassiere according to claim 14, characterised in that said rigidifying fibres (Fn, Fl, Fc) are of a diameter between 0.8 mm and 3 mm.

20. A rigidifying wire framework (1) for a part of a garment according to claim 1, characterised in that it is produced by coextrusion.

* * * * *